United States Patent [19]

Gooley

[11] Patent Number: 4,755,801

[45] Date of Patent: Jul. 5, 1988

[54] BUBBLE MOVEMENT DETECTOR SECURITY SYSTEM

[75] Inventor: Cornelius L. Gooley, Glen Iris, Australia

[73] Assignee: Eureka Developments Pty. Limited, Melbourne, Australia

[21] Appl. No.: 904,354

[22] Filed: Sep. 8, 1986

Related U.S. Application Data

[63] Continuation-in-part of Ser. No. 621,543, Jun. 18, 1984, abandoned.

[51] Int. Cl.[4] ..... G08B 13/02; G08B 13/14

[52] U.S. Cl. ..... 340/566; 33/366; 33/379; 250/574; 250/575; 340/539; 340/568; 340/689; 340/693

[58] Field of Search ..... 340/566, 568, 689, 571, 340/693, 539; 33/366, 379; 250/574, 575

[56] References Cited

U.S. PATENT DOCUMENTS

| | | | |
|---|---|---|---|
| 2,789,260 | 4/1957 | Curtis et al. | 318/466 |
| 3,657,551 | 4/1972 | Lingert et al. | 33/366 |
| 3,863,067 | 1/1975 | Gooley | 250/574 |
| 3,971,006 | 7/1976 | Pressly, Jr. | 340/539 |
| 4,154,000 | 5/1979 | Kramer | 33/366 |
| 4,182,046 | 1/1980 | Ludlow et al. | 33/366 |
| 4,590,680 | 5/1986 | Hanchett et al. | 33/366 |
| 4,594,582 | 6/1986 | Thompson | 340/566 |

FOREIGN PATENT DOCUMENTS

| | | | |
|---|---|---|---|
| 737643 | 7/1966 | Canada | 33/366 |
| 154030 | 8/1963 | U.S.S.R. | 33/366 |
| 0811075 | 3/1981 | U.S.S.R. | 33/366 |

*Primary Examiner*—Glen R. Swann, III

*Attorney, Agent, or Firm*—Stevens, Davis, Miller & Mosher

[57] ABSTRACT

The security apparatus is mounted to objects to indicate when a person or moving body is in the vicinity. Detection of movement or vibration is determined by air bubble movement in a liquid charged chamber. Light emitting means radiating from end placements of the chamber cause lateral reflections from the end edges of the bubble. Detecting apparatus senses the differential in received bubble edge illumination and activates security warning equipment when there is imbalance due to bubble movement. Bubble dimension changes due to temperature variations are nullified by balance sensing. Automatic sensitivity control by sensing ambient light or under timer control allows security maintenance over changing environmental backgrounds. Remote supervision by radio link is an embodiment. Security of the radio communication is maintained by a process of carrier frequency division used for self modulation of the carrier frequency signal.

15 Claims, 3 Drawing Sheets

BUBBLE MOVEMENT DETECTOR SECURITY SYSTEM

CROSS REFERENCE TO A RELATED APPLICATION

This is a continuation-in-part of U.S. patent application Ser. No. 621,543 filed June 18, 1984, now abandoned, in the name of C. L. Gooley.

BACKGROUND OF THE INVENTION

This invention relates to security protection apparatus used for example to detect the approach of an intruder to certain specified items or to detect the movement of the items from a chosen orientation or position.

The items may be objects or articles such as paintings or jewellery, machines of every type including office equipment, motor cars, industrial machinery and the like.

It has been noted that the observed devices in the security field, such as reed relays, mercury switches, vibrating reed and the like do not meet the desirable requirements of simplicity of construction and operation, sensitivity, accuracy and stability over periods of time and under varying temperatures.

An object of the present invention is to provide continuous movement sensing and further objects are that the initial stage of electronic circuit switching, whilst being extremely sensitive, is thoroughly reliable in repetitive operation requiring no mechanical setting or resetting, no deterioration in switching contacts, is not inhibited by changing ambient temperature. A further object is to provide a range of sensitivities which may be automatically operable according to the environment requirements and particularly enabling increased sensitivity at night.

A further object is that the movement sensor device be very small so as to be able to be positioned on small articles. Further objects are that the sensor require a minimum of skill to set up, the sensor be completely autonomous and self-contained, be adaptable to many security situations, the sensor enable a large measure of automation in its manufacture, and be cheap to produce.

SUMMARY OF THE INVENTION

According to the present invention there is provided security protection apparatus for warning of presence of a person or for warning of movement of a body, said protection apparatus including: movement sensing apparatus for sensing the presence of the person or the movement of the body and signalling means operative in response to operation of the movement sensing apparatus to generate a warning signal, said movement sensing apparatus including a liquid charge chamber mounted to said body, which is normally stationary, said chamber having a bubble movable within the chamber so that surfaces of the bubble within the chamber move as orientation of the chamber is changed or as the chamber is vibrated, electromagnetic radiation emitting means arranged to emit electromagnetic radiation into the chamber along two paths which are located generally along the line of movement of the bubble to impinge on two respective end edges of the bubble and be reflected laterally from those two end edges, radiation detecting means arranged to detect, independent of axial rotation of said chamber, radiation reflected laterally from the two end edges when the chamber is in a predetermined orientation in which the bubble adopts a predetermined position within the chamber and to generate two idensity signals, each being indicative of the intensity of the radiation reflected from a respective one of said two end edges and received by said radiation detecting means when the bubble is in said predetermined position and throughout a continuous range of possible positions of the said two end edges of the bubble, independent of axial rotation of said chamber, signal comparing means for continuously receiving the two intensity signals so as to determine whether the said two end edges have moved from or are vibrating about the positions of said two end edges when said chamber is in said predetermined orientation so as to thereby determine whether the chamber has been moved from said predetermined orientation or is being vibrated, said signal comparing means being operative to generate a movement signal indicative of movement of or vibration of said two end edges as a result of movement or vibration of said chamber, said signalling means being responsive to said movement signal to generate a warning signal, said chamber being provided within a housing and said radiation detecting means being positioned to detect radiation reflected by the end edges of the bubble through respective recesses in the housing, which recesses are immediately opposite the bubble end edges when the chamber is in said predetermined orientation.

The apparatus of the invention is preferably contained within a small opaque outer housing of plastic composition. With the provision of a battery power source, the apparatus may operate as a portable alarm unit, generating a radio alarm signal should there be the slightest movement of the module and hence the article on which it is placed or in which it is contained. The sensitivity of detection and operation is adjustable in incremental steps, thus allowing the vibration of approaching footsteps to actuate the alarm. In other environments, wherein numbers of people are active, the sensitivity may be set to operate only when the module or the article associated with it is actually touched or moved. An embodiment of the invention allows this change in sensitivity according to the environment to be automatically effected. In particular, the signal comparing means may be of variable sensitivity so that when operable in a less sensitive mode of operation, the movement signal is not generated except by relatively large amplitude movement of the chamber from the predetermined orientation and when operable in a more sensitive mode of operation the movement signal is generated in response to either a relatively amplitude movement of the chamber or small amplitude vibrational movement of the two surface parts of the bubble. The apparatus of the invention is electronic and sensitivity of operation may be conveniently set by gain and balance controls of the circuitry. Vials containing liquids of different viscosities may also be provided to enable the same basic module to be used for different dedicated uses, the appropriate vial being introduced at the point of manufacture.

In all instances of the invention, the detection of movement of the module and its associated article is originated by the movement of the air bubble within the chamber partially filled with a liquid. This chamber is defined by a moulded transparent plastics block with the hollow interior liquid chamber of approximately tube shape being preferably contoured around its circumference to give a slightly barrel shaped appearance with the high point of the barrel occurring at the central longitudinal position of the vial. Thus the air bubble resides at this central position when the containing module is horizontal. Should the vial be rotated about its horizontal longitudinal axis, the bubble will not depart from this central position. This feature allows the module to be placed upside down, or thereabouts, with the detection process fully operable. The outside surface of the liquid chamber is flat and may form a rectangular shape with recesses of square shape moulded into the end walls of the liquid chamber to accommodate square shaped light emitting diodes (L.E.D.'s) of the infrared-red type. In one instance the transparent plastic block enclosing the liquid chamber measured 32 mm long, 15 mm wide, 20 mm depth. One of the top surfaces of the block had recesses moulded therein to allow square shaped photo-transistors to be positioned opposite the air bubble edges when the module is horizontal and hence the bubble is centered in the vial. These photo-transistors or diodes are mounted flush with the surface. The top surface of the block was further hollowed out in the moulding process to form an accomodating enclosure some 5 mm in depth above the surface containing the flush mounted photo-detectors. This enclosure allows for example a substrate 3 mm thick, 13 mm wide, 18 mm long to be mounted therein. This substrate includes an integrated circuit including a differential amplifier with associated resistors, capacitors and the like components.

When the air bubble is located at the central position and the L.E.D.'s located at the ends of the liquid chamber are on, light is transmitted longitudinally through the liquid to impinge on the two bubble end edges thereby causing light to be laterally reflected equally in the areas of detection of the photo transistors since these photo sensitive transistors are positioned opposite these bubble edges. The outputs of the photo transistors connect to the positive and negative inputs of the differential amplifier and if the bubble is centrally located, there will be equal intensities of illumination detected and there is no output from the amplifier. Should however the bubble move in either the right hand or left hand direction, there is immediate positive or negative output potential from the amplifier. This arrangement prevents bubble enlargement or contraction, caused by ambient temperature changes, from causing false alarm signals, since equal simultaneous movements of the bubble edges in the right and left hand direction produce no difference in comparable illumination values. Photo transistors or diodes with wide angle detection characteristics are used to detect small incremental changes in received illumination as a consequence of bubble movement in the liquid chamber. Digital readout of the bubble's movement may be provided by connecting a digital voltmeter or current meter across the output of the amplifier. This facility can be of use in setting the sensitivity of alarm apparatus connected to the module. The amplifier output may activate a low power radio transmitter contained within the same module or it may operate a directly connected alarm apparatus.

To prevent the air bubble from escaping both areas of detection thus allowing a vial tilted condition to be signalled as a non-alarm condition, the bubble size and the length of the liquid chamber are so proportioned as to allow the bubble edge to be within the detection area of either the right or left hand photo transistor even when the module is elevated 90 degrees. Thus should the module be knocked over, the alarm condition is still operative.

In another instance, the differential amplifier may be a miniature discrete unit of typical 8 pin configuration connected into the integrated circuit substate via pin connections. This allows an appropriate amplifier to be selected and included at point of manufacture thus providing a selectable range of operating parameters such as gain, sensitivity, noise, voltage, power consumed, biasing point and the like. The substrate in this case contains all the components necessary for module operation other than the amplifier, L.E.D.'s and photodetectors. Terminals on the substrate provide power connections. With the rectangular transparent plastic block containing the liquid chamber, integrated circuit substrate, L.E.D.'s and photo transistors, a compact unit of smooth outline is possible. The block may be further encapsulated in an opaque outer housing. In another option, there may be provided a second substrate associated with a low power radio transmitter to be also housed in this outer housing.

In one embodiment of the invention, the radio transmitter comprises a low power 27 MHz crystal controlled unit. Some of the transmitter output before finally coupling to the aerial is coupled to a divide by 64 pre-scaler, and then to a 14 stage binary divider which provided at its 12 outputs frequencies ranging from 210.937 KHz to 25.749 Hz. These frequencies are connected via a 12 position miniature dip switch, the outputs of which were commoned to allow connection of any one frequency or combination of frequencies to a modulating diode which connected to a point on the transmitter's collector circuit to effect modulation. The transmitter may be frequency or amplitude modulated.

In one case the output voltage from the vial unit, when energized by bubble movement, caused a reed relay to supply battery power to the radio unit causing a 27 MHz signal modulated by stage 9 output (823.99 Hz) to be transmitted.

A receiver unit is tuned to the transmitted signal and has the same frequency division circuitry. The 27.823 MHz signal feeds into prescaler and binary units to produce the 823.99 Hz frequency. The carrier modulated signal further proceeds through the receiver which may be of the superherterodyne type, to be demodulated back to a second appearance of the 823.99 Hz signal. These two audio signals are then applied to a phase comparator. If these two frequencies are identical, there will be no output. This condition, after being detected, causes the alarm signal to be given, whereas a 27 MHz signal with a modulation signal not precisely 823.99 Hz will not actuate the alarm, since there would not be cancellation in the comparator.

The provision of a light dependent resistor in the gain circuit of the differential amplifier allows the sensitivity of the amplifier to be greater in darkness than in daylight. Thus the module may act on the vibration of footsteps during the night (as well as on large scale movement or tilting of the module), but return to a lesser sensitivity enabling triggering only upon the sensing of touch and handling during the daylight or during times of lighting of the ambient background. The application of this light sensitive embodiment to business locations, picture galleries and the like is obvious. The light dependent resistor may be contained in the outer surface of the opaque module so as to be sensitive to ambient lighting.

In other areas of application, such as security of office machines and the like, the module unit which may be present in each machine may have its gain terminals available for relay contact gain variation. Thus during business hours the relays may be operated by a common wire connection to give minimum sensitivity. Outside these hours, the common control may be timer controlled to release, thus giving maximum sensitivity to movement detection.

In a further application, the module in conjunction with the radio transmitter described previously formed the basis for a swimming pool alarm. Mounted on a plastic float platform, around the perimeter of which four arms of small dimensions extended to terminate in four float balls, the module responded to a body falling into the water. The vertical displacement caused by surface waves actuates the radio alarm. The sensitivity of detection was set by the amplifier gain control, and by adjusting the length of the ball float arms. These arms also prevented the flat from snagging on pool walls. With this arrangement, the temperature independence of the apparatus is particularly important because the apparatus will be exposed to a wide range of ambient temperatures (night-time temperature, direct sunlight, etc.).

BRIEF DESCRIPTION OF THE DRAWINGS

Other details and features of the invention will stand out from the description given below by way of non-limitative example and with reference to the accompanying drawings, in which.

DESCRIPTION OF THE PREFERRED EMBODIMENTS

Figure 1:
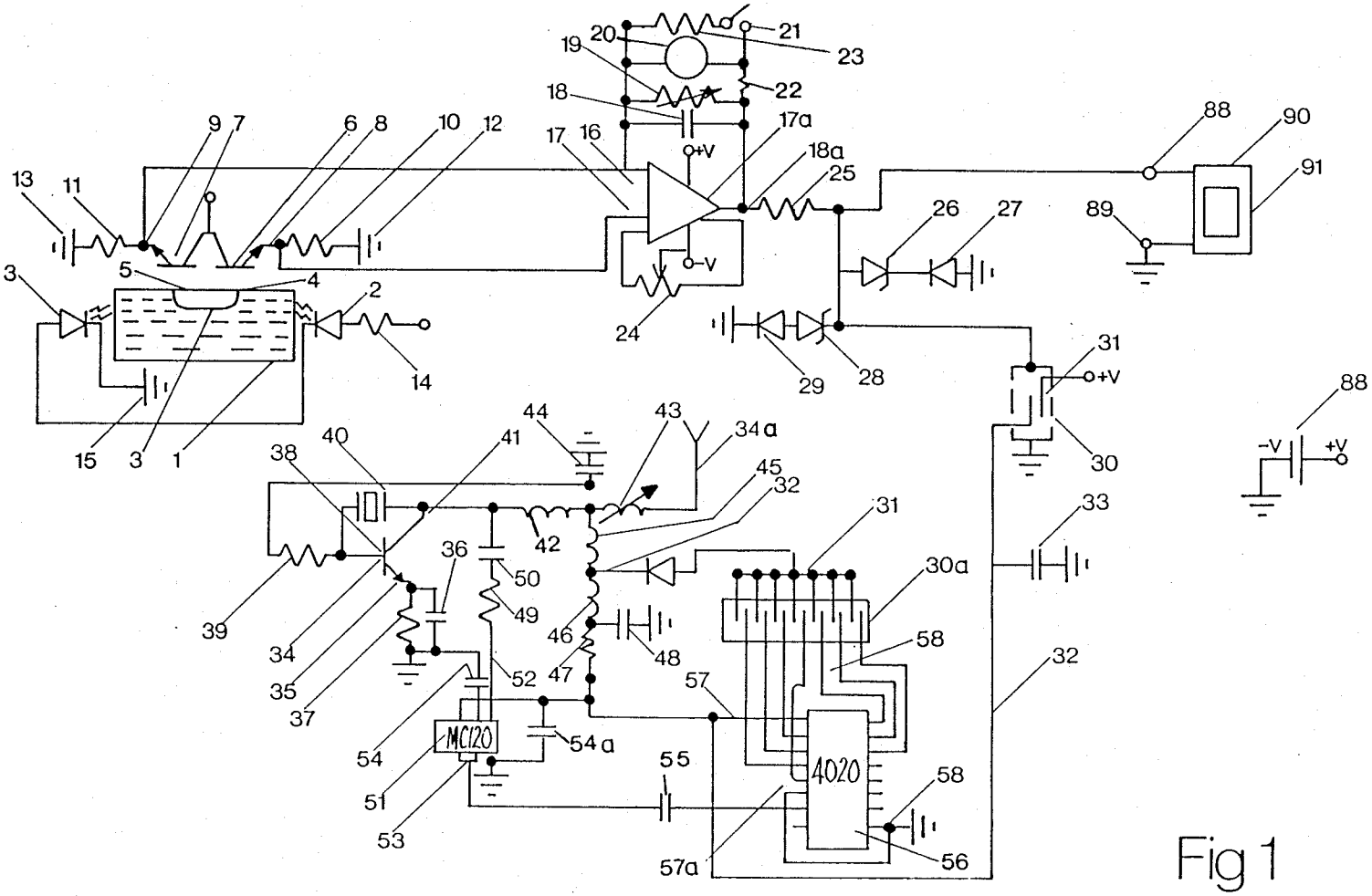
FIG. 1 is a circuit diagram of apparatus according to the invention.

FIG. 1 shows schematically a module unit with associated radio alarm unit. At 1 is shown the vial or liquid chamber, 3*a* shows the air bubble with the illuminating diodes 2 and 3 positioned at the end extremities of the vial chamber 1. The bubble edges 4 and 5 are shown opposite photo transistors 6 and 7 whose collectors are commoned and connected to positive supply. The emitters 8 and 9 are connected via resistors 10 and 11 to ground or zero volts at 12 and 13. A limiting current resistor 14 connects positive supply to the light emitting diodes 2 and 3. With 9 volt supply the value of resistor 14 may be 6K ohms. The emitters 8, 9 of the photo-transistors, which in one case were MRD711, also connected to the positive and negative inputs 16, 17 of the differential amplifier 17*a*, which has normal gain potentiometer 19 connected between negative input 16 and output terminal 18*a* of the amplifier. A selected capacitor 18 connects across the gain control 19 which may be 1 Megohm in value, with the capacitor 18 ranging from 150 MMF to 0.001 MF depending on the sensitivity and stability required. Between the output 18*a* and negative terminal 16 there may be also a photo resistor 20 in series with padding resistor 22. In periods of daylight or ambient lighting, this resistor 20 can be of low value and can shunt the network across the gain control to give a sensitivity depending upon the padding resistor 22 suitable for daylight operation. Also across this amplifier gain network is shown relay contacts 21 in series with padding resistor 23. These contacts 21 are operated by remote operation to give changes in sensitivity according to business hours. 24 shows off-set nulling control. 25 is a limiting resistor in series with amplifier output 18*a*. When there is left or right hand bubble movement, there is a positive or negative output voltage at the amplifier output 18*a*, thus there is shown a protective shunting diode and zener diode network 26, 27, 28, 29. It can be seen that during daylight hours the light dependent resistor 20 is of low resistance, thus with the padding resistor 22, can be set for a sensitivity of operation suitable for daylight use. In darkness, this light dependent resistor 20 is of high value and can be considered open circuit. thus allowing the initial sensitivity to be set by potentiometer 19.

At 30, there is shown reed relay whose contacts 31 connect positive power via wire 32 to a portable radio transmitter, the aerial of which is shown at 34*a*. Either positive or negative output volts causes relay contacts 31 to close thus energizing the transmitter. At 34 is shown oscillator transistor with its emitter 35 coupled via resistor 37 and capacitor 36 to zero volts. The resistor may be 200 ohms and capacitor 0.001 Mf. The base 38 connects via resistor 39, which is of 20K ohms, to the positive power point feeding the collector. The base 38 also connects via 27 MHz crystal 40 to collector 41 which connects via tuning coils 42 and 43 to aerial 34*a*. Coil 43 is slug tuned.

At the coil junction, there connects R.F choke 45 in series with additional choke 46 and resistor 47 to positive power. This supplies power to both base circuit and collector of transistor 34. The collector 41 also connects via 47 ohm resistor 49 and coupling capacitor 50 (0.001 MF) to pre-scaler 51 which is of MC 120 type, pin 4 of which connects to ground, pin 5 which is input connects via wire 52 to capacitor 50, pin 6 is decoupled to ground via capacitor 54 (331 MMF), pin 7 connects to positive power and decoupled to ground via condenser 54*a* (10 Mf). The pre-scaler 51 divides the 27 MHz signal by a factor of 64. The output of pre-scaler 51 at commoned pins 2 & 3 connects via capacitor 55 to a 14 stage binary counter 56 (4020 type). This divider has 12 outputs, some of which are shown connecting to dip switch 30*a*. Pin 8 of counter 56 connects to earth, pin 16 shown at 57 connects to positive power, the reset pin 57*a* connects to ground. The seven frequencies connecting to serve position dip switch 30*a* may range in frequency from 25.7 Hz to 1.647 KHz. These frequencies can be selected either separately or combined via the commoned output 31 of the switch. The selected output is then applied via modulating diode 32 to midpoint of the R.F. chokes 45, 46 shown at 33. Thus the transmitter frequency is divided down into audio frequencies and then re-applied to modulate the transmitter. This arrangement guards against a spurious or foreign transmission generating the alarm condition. The transmitter can be amplitude or frequency modulated with the same result. In a further reference to FIG. 1, the output of the differential amplifier 17*a* is shown connected across terminals 88, 89 which are connected to digital voltmeter 90 providing a display shown at 91. The meter is capable of automatic reading of positive or negative voltages.

Figure 2A:
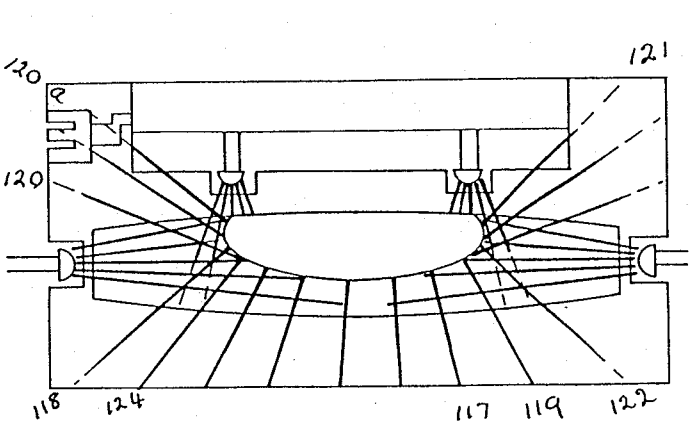
FIGS. 2 and 2*a* are sections through the movement sensing module.
Figure 2:
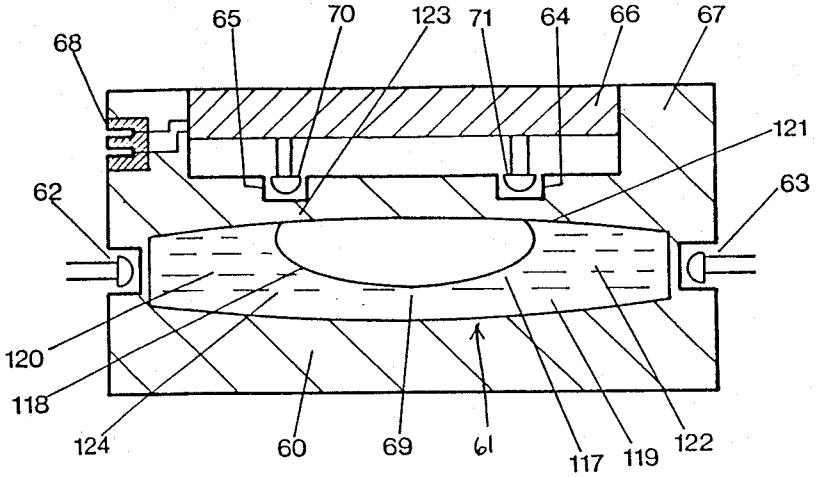

FIG. 2 shows a module comprising a transparent plastics block 60 with liquid chamber or vial 61. Recesses are molded into the transparent block 60 to position the L.E.D.'s shown at 62 and 63. Recesses 64, 65 are also molded in the top surface of the block enclosing the liquid chamber and positioned opposite the edges of the air bubble when the module is horizontal. The substrate 66 has the photodetectors 70, 71 mounted thereon, which detectors locate in the associated molded recesses when the substrate 66 is positioned in the module upper housing 67. The lower middle section of the air bubble 69 extends to a point which is greater than half the depth of the inner vial chamber. The effect of this bubble shape is illustrated in FIG. 2*a* which shows light from the bubble edges, being deflected laterally in all directions. The left hand bubble edge shows at 120*a* to 124, light deflected laterally towards the top and bottom sections of the vial, as well as all intermediate lateral directions. At the right hand bubble edge this is shown at 117 to 121. This allows the module to be fully operational in any rotational orientation of the module in the horizontal plane.

Figure 3:
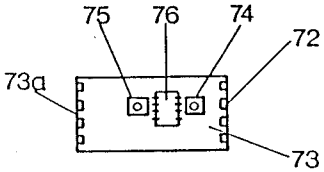
FIG. 3 is a plan view of the circuit substrate.

FIG. 3 shows substrate 72 with connecting tabs 73, 73*a*, detectors 74, 75 and a differential amplifier 76 which is not integral within the surface of the substrate. With this arrangement, the amplifier 76 can be interchanged since it is a discrete item. The external connecting pins of the module are shown at 68 in FIG. 2.

Figure 4:
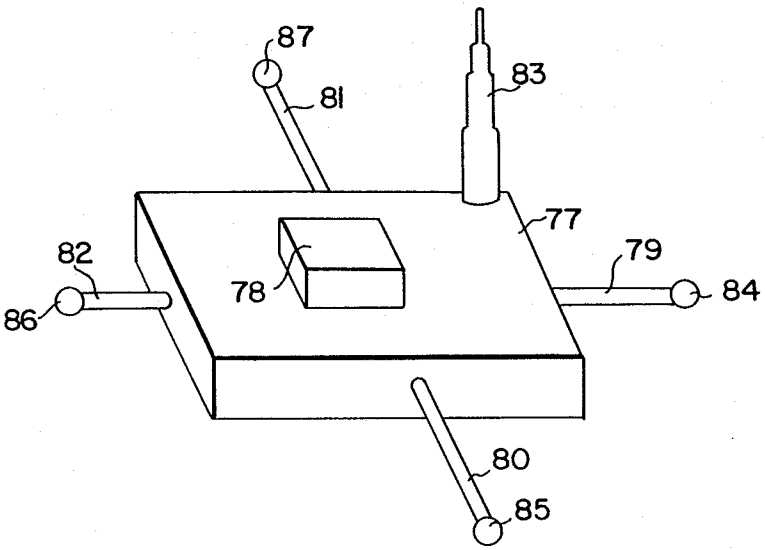
FIG. 4 is a schematic view of a swimming pool security apparatus.

FIG. 4 shows a swimming pool alarm wherein the module 78, complete with radio transmitter and aerial 83, is mounted upon plastics float 77 which has extension arms 79–82. These arms 79–82 terminate in plastic ball ends 84–87. The arms act as stabilizers with ball floats on the ends and they also keep the unit from contacting the walls of the pool. The arms may be adjusted in length. The arms are about 8 cm. long and the float body is 15 cm. long, 10 cm. wide, and 2 cm. deep. When the surface of the pool is disturbed by a body falling into it, the module 78 on the float 77 is displaced from the horizontal resulting in movement detection by the contained air bubble and hence transmission of the radio alarm signal as has been described. The sensitivity of detection is set by the gain control of the differential amplifier. Large excursions of the ambient temperature, obvious in this application, do not cause false alarms by the method of detection as has been outlined.

What I claim is:

1. Security protection apparatus for warning of presence of a person or for warning of movement of a body, said protection apparatus including: movement sensing apparatus for sensing the presence of the person or the movement of the body and signalling means operative in response to operation of the movement sensing apparatus to generate a warning signal, said movement sensing apparatus including a liquid charged chamber mounted to said body, which is normally stationary, said chamber having a bubble movable within the chamber so that surfaces of the bubble within the chamber move as orientation of the chamber is changed or as the chamber is vibrated, electromagnetic radiation means arranged to emit electromagnetic radiation into the chamber along paths which are located generally along the line of movement of the bubble to impinge on two respective end edges of the bubble and be reflected laterally from those two end edges, radiation detecting means arranged to detect substantially independent of axial rotation of said chamber, radiation reflected laterally from the two end edges when the chamber is in a predetermined orientation in which the bubble adopts a predetermined position within the chamber, and to generate two intensity signals each being indicative of the intensity of the radiation reflected from a respective one of said two end edges and received by said radiation detecting means when the bubble is in said predetermined position and throughout a continuous range of possible positions of the said two end edges of the bubble substantially independent of axial rotation of said chamber, signal comparing means for continuously receiving the two intensity signals so as to determine whether the two end edges have moved from or are vibrating about the positions of said two end edges when said chamber is in said predetermined orientation so as to thereby determine whether the chamber has been moved from said predetermined orientation or is being vibrated, said signal comparing means being operative to generate a movement signal indicative of movement of or vibration of said two end edges as a result of movement of vibration of said chamber, said signalling means being responsive to said movement signal to generate a warning signal, said chamber being provided within a housing and said radiation detecting means being positioned to detect radiation reflected by the end edges of the bubble through respective recesses in the housing, which recesses are immediately opposite the bubble end edges when the chamber is in said predetermined orientation.

2. Security protection apparatus as claimed in claim 1, wherein the internal surface of said liquid chamber is barrel shaped.

3. Security protection apparatus as claimed in claim 1, wherein said housing is proportioned to form an autonomous alarm system which may be applied to small articles.

4. Security protection apparatus as claimed in claim 1, wherein said radiation emitting means are arranged to emit substantially equal intensity radiation beams into the chamber to impinge on said two end edges of the bubble which are symmetrically located relative to the bubble configuration, the radiation detecting means being symmetrically located relative to the bubble position when the chamber is in said predetermined orientation so as to detect radiation reflected symmetrically from said end edges, said signal comparing means being operable to continuously compare the two intensity signals so as to detect when the two intensity signals are equal to each other or when there is imbalance between the two intensity signals as a result of movement of the bubble from or about said predetermined position.

5. Security protection apparatus as claimed in claim 1, wherein opposed ends of said housing are provided with respective radiation-source-accommodating recesses having therein respective radiation emitting means arranged to emit radiation longitudinally into the liquid charged chamber, the two radiation emitting means being substantially identical and the radiation emitted thereby being attenuated equally in passing into and along said chamber before encountering and being reflected by the end edges of the bubble.

6. Security protection apparatus as claimed in claim 1, wherein said housing comprises a molded transparent plastic block, said block providing mountings for light emitting diodes constituting said radiation emitting means, photodetectors constituting said radiation detecting means, and a hybrid integrated circuit substrate having said signal comparing means provided thereby, said substrate providing for selective assembly therewith of discrete miniature differential amplifiers operative to compare the two intensity signals thereby providing for interchangeability of amplifiers for particular purposes of the apparatus.

7. Security protection apparatus as claimed in claim 1, wherein said signal comparing means includes a differential amplifier for comparing the two intensity signals, the output of the differential amplifier being applied to a relay, said relay being operable independent of the voltage polarity of the differential amplifier output whereby an imbalance between said two intensity signals in either direction can cause operation of said relay, said signalling means including a radio transmitter operable in response to operation of said relay to generate a radio signal indicative of movement or of vibration of said two end edges.

8. Security protection apparatus as claimed in claim 1, wherein said signalling means includes a radio signal transmitter operable to generate a radio signal in response to said movement signal, said radio signal transmitter including an oscillator for generating a carrier frequency signal, said carrier frequency signal being connected to a prescaler the output of which is applied to a binary counter so as to make available a plurality of differing frequency signals for modulation of the carrier frequency signal.

9. Security protection apparatus as claimed in claim 8, wherein said signalling means includes a selectively operable switching means for selecting one or more of said differing frequency signals to be used for modulation of said carrier frequency signal.

10. Security protection apparatus as claimed in claim 1, wherein said signalling means includes a radio signal transmitter for generating and transmitting a radio frequency signal in response to said movement signal, said radio transmitter including an oscillator for generating a carrier frequency signal, said carrier frequency signal being modulated by one or more frequencies derived from said oscillator-generated carrier frequency signal to enable generation of a self modulated radio signal.

11. Security protection apparatus as claimed in claim 10, wherein said radio transmitter includes a dividing means for dividing the carrier frequency signal, the output of the dividing means being applied to a modulating diode connected to the midpoint of a radio frequency choke network driven by the carrier frequency signal.

12. Security protection apparatus for warning of presence of a person or for warning of movement of a body, said security protection apparatus including: movement sensing apparatus for sensing the presence of the person or the movement of the body and signalling means operative in response to operation of the movement sensing apparatus to generate a warning signal, said movement sensing apparatus including a chamber mounted to said body, which is normally stationary, said chamber being charged with a liquid and having a bubble movable within the chamber so that surfaces of the bubble within the chamber move as the orientation of the chamber is changed or as the chamber is vibrated, said liquid having a low viscosity so that relatively small changes in the orientation of the chamber cause corresponding changes in the position of the bubble within the chamber and such that ambient temperature variations cause expansion and contraction of bubble size, radiation emitting means arranged to emit radiation into the chamber along paths which are located generally along the line of movement of the bubble to impinge on two respective convex surface parts of the bubble and be reflected laterally from those surface parts in a plurality of directions relative to the said paths, two radiation detecting means, each being arranged to detect substantially independent of axial rotation of said chamber, radiation reflected laterally from said respective surface parts when the chamber is in a predetermined orientation in which the bubble adopts a predetermined position with the chamber as well as when the chamber is not in said predetermined orientation and each detecting means being operative to generate an intensity signal indicative of total reflected radiation intensity detected thereby from said respective surface parts when the bubble is in said predetermined position and throughout a continuous range of possible positions of said surface parts of the bubble, substantially independent of axial rotation of said chamber, said intensity signals generated by said detecting means being equal to each other but not equal to a constant value when said bubble is in said predetermined position throughout a range of ambient temperatures and consequent range of bubble sizes, signal comparing means for continuously receiving the two intensity signals and for continuously comparing those two signals so as to determine whether the said two surface parts have moved from or are vibrating about the positions of said two surface parts when said chamber is in said predetermined orientation as indicated by an inequality in said intensity signals which is substantially temperature independent so as to thereby determine whether the chamber has been moved from said predetermined orientation or is being vibrated, said signal comparing means being operative to generate a movement signal indicative of movement of or vibration of said surface parts as a result of movement or vibration of said chamber by a person or movement of the body, said signalling means being responsive to said movement signal to generate a warning signal, said chamber, radiation emitting means, radiation detecting means, and signal comparing means together with a power supply for said apparatus all being mounted in a housing, the housing being mounted to a buoyant body for floating in a swimming pool whereby surface waves generated in the swimming pool when a person or other object enters the pool cause a change in orientation of the chamber sufficient for generation of said movement signal, said buoyant body including a plurality of generally coplanar radiating arms having buoyant pieces mounted thereto, the length of at least one of the arms being selectively adjustable so as to enable selective adjustment of the sensitivity of the buoyant body to movement in response to surface waves in the swimming pool.

13. Security protection apparatus for warning of presence of a person or for warning of movement of a body, said security protection apparatus including: movement sensing apparatus for sensing the presence of the person or the movement of the body and signalling means operative in response to the operation of the movement sensing apparatus to generate a warning signal, said movement sensing apparatus including a liquid charged chamber mounted to said body, which is normally stationary, said chamber having a bubble movable within the chamber so that the surfaces of the bubble within the chamber move as orientation of the chamber is changed or as the chamber is vibrated, radiation emitting means arranged to emit radiation into the chamber along two paths to impinge on two respective surface parts of the bubble and be reflected laterally from those two surface parts, radiation detecting means arranged to detect radiation reflected laterally from the two surface parts when the chamber is in a predetermined orientation in which the bubble adopts a predetermined position with the chamber and to generate two intensity signals indicative of intensity of radiation reflected from said two surface parts and received by said radiation detecting means when the bubble is in said predetermined position and throughout a continuous range of possible positions of the said two surface parts of the bubble, signal comparing means for receiving the two intensity signals and for continuously comparing those two signals so as to determine whether the two surface parts have moved from or are vibrating about the positions of said two surfaces parts when said chamber is in said predetermined orientation to thereby determine whether the chamber has been moved from said predetermined orientation, said signal comparing means being operative to generate a movement signal indicative of movement of said two surface parts as a result of movement of said chamber by a person or movement of the body, said signal comparing means being of variable sensitivity so that, when operated in a less sensitive mode of operation, said movement signal is not generated except by relatively large amplitude movement of the chamber from said predetermined orientation, and when operated in a more sensitive mode of operation, said movement signal is generated in response to either relatively large amplitude movement of the chamber or small amplitude vibrational movement of the two surface parts of the bubble, said signalling means being responsive to said movement signal to generate a warning signal.

14. Security protection apparatus as claimed in claim 13, wherein said signal comparing means is operable in its said less sensitive mode of operation when ambient light intensity is relatively high and is operable in its said more sensitive mode of operation when the ambient light intensity is relatively low, whereby said security protection apparatus is more sensitive under dark ambient conditions.

15. Security protection apparatus as claimed in claim 14, wherein said signal comparing means includes light sensitive means operative to change the sensitivity of the signal comparing means from its less sensitive mode of operation to its more sensitive mode of operation upon detection of a reduction in ambient light intensity.

* * * * *